US007220046B2

(12) United States Patent
Lee et al.

(10) Patent No.: US 7,220,046 B2
(45) Date of Patent: May 22, 2007

(54) REPLACEABLE LAMP HEADER

(75) Inventors: John Lee, Sweet Home, OR (US); David Huhn, Monmouth, OR (US); Andrew Lovvorn, Albany, OR (US); Jimmy Perez, Corvallis, OR (US); Bob Sattem, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 115 days.

(21) Appl. No.: 10/903,536

(22) Filed: Jul. 29, 2004

(65) Prior Publication Data

US 2006/0023473 A1 Feb. 2, 2006

(51) Int. Cl.
*H01R 33/00* (2006.01)

(52) U.S. Cl. ..... 362/655; 362/519; 362/657; 362/658; 362/659; 313/49; 313/318.06; 313/318.11

(58) Field of Classification Search ..... 362/657–659, 362/519, 546, 549, 655; 313/318.11, 49–51, 313/318.01, 318.06, 318.12

See application file for complete search history.

(56) References Cited

U.S. PATENT DOCUMENTS

| | | | | |
|---|---|---|---|---|
| 2,562,887 | A * | 8/1951 | Beese | 398/182 |
| 4,257,764 | A * | 3/1981 | Rainone | 431/359 |
| 4,608,624 | A * | 8/1986 | Blaisdell et al. | 362/659 |
| 5,075,586 | A * | 12/1991 | Jaeger et al. | 313/25 |
| 5,250,874 | A | 10/1993 | Hall | |
| 6,083,012 | A | 7/2000 | Suzuki | |
| 6,467,911 | B1 | 10/2002 | Ueyama et al. | |
| 6,505,940 | B1 | 1/2003 | Gotham et al. | |
| 2005/0169014 | A1 * | 8/2005 | Koegler et al. | 362/647 |

FOREIGN PATENT DOCUMENTS

WO WO 2005/076603 8/2005

* cited by examiner

*Primary Examiner*—Stephen Husar
*Assistant Examiner*—Meghan K. Dunwiddie

(57) ABSTRACT

A replaceable lamp header for positioning a lamp within a reflector assembly includes a base member having first and second lateral portions, at least one first source connection coupled to each of the first and second lateral portions, at least one second source connection coupled to each of the first and second lateral portions, a first interconnect coupling the first source connections and being external to the base member, and a second interconnect coupling the second source connections and being external to the base member.

31 Claims, 6 Drawing Sheets

REPLACEABLE LAMP HEADER

BACKGROUND

Digital projectors, such as digital mirror devices (DMD) and liquid crystal display (LCD) projectors, project high quality images onto a viewing surface. Both DMD and LCD projectors utilize high intensity lamps and reflectors to generate the light needed for projection. Light generated by the lamp is concentrated as a "fireball" that is located at a focal point of a reflector. This light is directed into a projection assembly that produces images and utilizes the generated light to form the image. The image is then projected onto a viewing surface. Misalignment of the focal point causes degradation of the image, since less light is captured, and creates "hot spots" on the screen instead of a uniform brightness.

Efforts have been directed at making projectors more compact while making the image of higher and higher quality. As a result, the lamps utilized have become more compact and of higher intensity. Higher intensity lamps produce high, even extreme heat. The outer surface of the lamps can approach temperatures of 900° C. As a result, projector designs must account for the intense heat. In addition, losses due to misalignment of the fireball with respect to the reflector are amplified in systems utilizing high intensity lamps.

Some designs attempt to account for the heat by permanently placing the lamp within the reflector. The use of a high temperature 'epoxy' holds the lamp relative to the reflector. When the lamp has surpassed its useful life, the costly reflector and lamp assembly, which can be considered as the light generation assembly, is discarded and replaced with a new assembly.

SUMMARY

A replaceable lamp header for positioning a lamp within a reflector assembly includes a base member having first and second lateral portions, at least one first source connection coupled to each of the first and second lateral portions, at least one second source connection coupled to each of the first and second lateral portions, a first interconnect coupling the first source connections and being external to the base member, and a second interconnect coupling the second source connections and being external to the base member.

BRIEF DESCRIPTION OF THE DRAWINGS

The accompanying drawings illustrate various embodiments of the present apparatus and method and are a part of the specification. The illustrated embodiments are merely examples of the present apparatus and method and do not limit the scope of the disclosure.

DETAILED DESCRIPTION

Lamp headers with electrical connections are provided herein that are configured to be removably coupled to a reflector assembly. The electrical connections coupled to the lamp headers further allow the lamp headers to be coupled to a reflector assembly in a plurality of configurations, while still providing electrical connections for connecting a lamp to a power source. The electrical connections discussed herein may be rapidly formed and coupled to a lamp header. Further, lamps may be rapidly coupled to these electrical connections. The rapid coupling of the electrical connections to the lamp header and the rapid coupling of the lamp to the lamp header reduces the time required to form a lamp assembly. This reduction in time reduces the cost of forming such a lamp assembly. Further, the lamp headers may be formed using solid ceramic materials, thereby further reducing the time and expense of forming a lamp assembly.

One exemplary lamp header and lamp assembly will be discussed that makes use of preformed electrical contacts. Another exemplary lamp header and assembly will then be discussed that make use of flexible interconnects followed by a discussion on another exemplary lamp header and assembly that make use of a two-sided circuit board. These electrical connections may be rapidly coupled to a lamp header while providing adequate electrical insulation from other electrical connections.

In the following description, for purposes of explanation, numerous specific details are set forth in order to provide a thorough understanding of the present method and apparatus. It will be apparent, however, to one skilled in the art, that the present method and apparatus may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Figure 1:
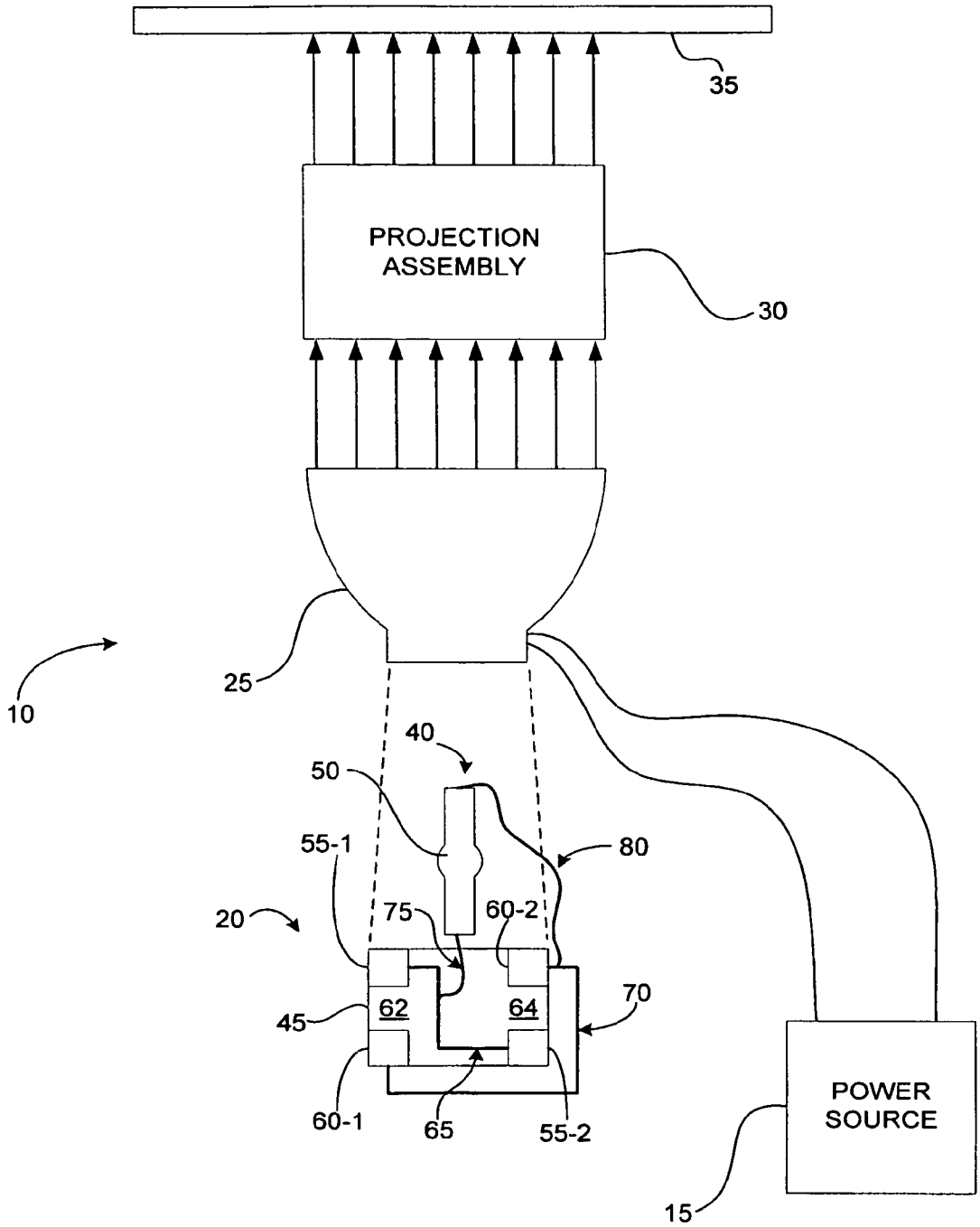
FIG. 1 is a schematic view of an exemplary display system.

FIG. 1 is a schematic view of a display system (10). The general operation of the display system (10) will first be discussed, followed by a discussion of the particular features of a generalized lamp header. The display system (10) generally includes a power source (15), a lamp assembly (20), a reflector assembly (25), a light modulator or projection assembly (30), and a viewing surface (35). The lamp assembly (20) is configured to be removably coupled to the reflector assembly (25). The power source (15) is also coupled to the reflector assembly (25). In particular, the power source (15) is coupled to the reflector assembly (25) such that when the lamp assembly (20) is also coupled to the reflector assembly (25), the power source (15) is able to provide power to the lamp assembly (20). The lamp assembly (20) generates light when the lamp assembly (20) receives power from the power source (15). This light is directed by the reflector assembly (25) to the projection assembly (30). The projection assembly (30) modulates the light to form images that are projected onto the viewing surface (35).

The lamp assembly (20) includes a lamp (40) coupled to a lamp header (45). The lamp engaging member of the lamp assembly (20) has been omitted to focus on the general configuration of the connection assembly. The lamp (40) emits concentrated light from a central portion or fireball generator (50). In some embodiments, the optimal operating position of the fireball generator (50) is the focal point of the reflector assembly (25) during operation of the lamp (40). Frequently, as the lamp (40) is heated from a non-operating temperature to an operating temperature, the fireball generator (50) will change positions in response to heating or gravitational effects. Accordingly, with some embodiments, once the lamp (40) is cool, the position of the fireball generator (50) is offset slightly from the focal point to account for such heating or gravitational effects during operation.

The present apparatus also provides for the maintenance of this optimal position, regardless of the mounting configuration of the reflector assembly (25). One exemplary mounting configuration for the display system (10) is on a table. In this configuration, the reflector assembly (25) is in a first orientation. As previously discussed, the heat generated by the lamp (40) is extreme. When the fireball generator (50) elevates due to the heat, it elevates to its optimal position with respect to the reflector assembly (25).

However, when the projector system is inverted, as would be the case if the projector system is mounted to an overhead support such as a ceiling, the reflector assembly (25) is inverted from the first orientation to a second orientation. As a result, in order to maintain the fireball generator (50) in the optimal position with respect to the reflector assembly (25), after the fireball generator (50) elevates as a result of heating, it would be necessary to rotate the lamp assembly 180 degrees with respect to the reflector assembly (25) to a second orientation.

The configuration of the lamp header (45) allows such rotation because first and second source connections (55-1, 55-2, 60-1, 60-2) are disposed on each first and second lateral portions (62, 64 respectively) of the lamp header (45). These source connections (55-1, 55-2, 60-1, 60-2) provide an interface for coupling the lamp header (45) to the power source (15). The first source connections (55-1, 55-2) are coupled to each other by way of a first interconnect (65), and the second source connections are coupled to each other by way of a second interconnect (70). The first source connections (55-1, 55-2) are also coupled to a first lead (75). Accordingly, the first lead (75) is coupled to the first source connections (55-1, 55-2) by way of the first interconnect (65). As a result, when the first source connection (55-1, 55-2) is coupled to the power source (15), the first lead (75) is also coupled to the power source (15). Similarly, a second lead (80) is coupled to the second source connections (60-1, 60-2) by way of the second interconnect (70).

Several approaches may be used to couple the first interconnect (65) and second interconnect (70) to the first source connections (55-1, 55-2) and second source connections (60-1, 60-2) respectively. Some of these exemplary structures also insulate the first interconnect (65) from the second interconnect (70). Further, some exemplary approaches make use of connections that are readily attached to the lamp header (45). Connection assemblies that are attached to the lamp header (45) may reduce the time required to form lamp assemblies, thus reducing the cost of forming lamp assemblies.

Figure 2:
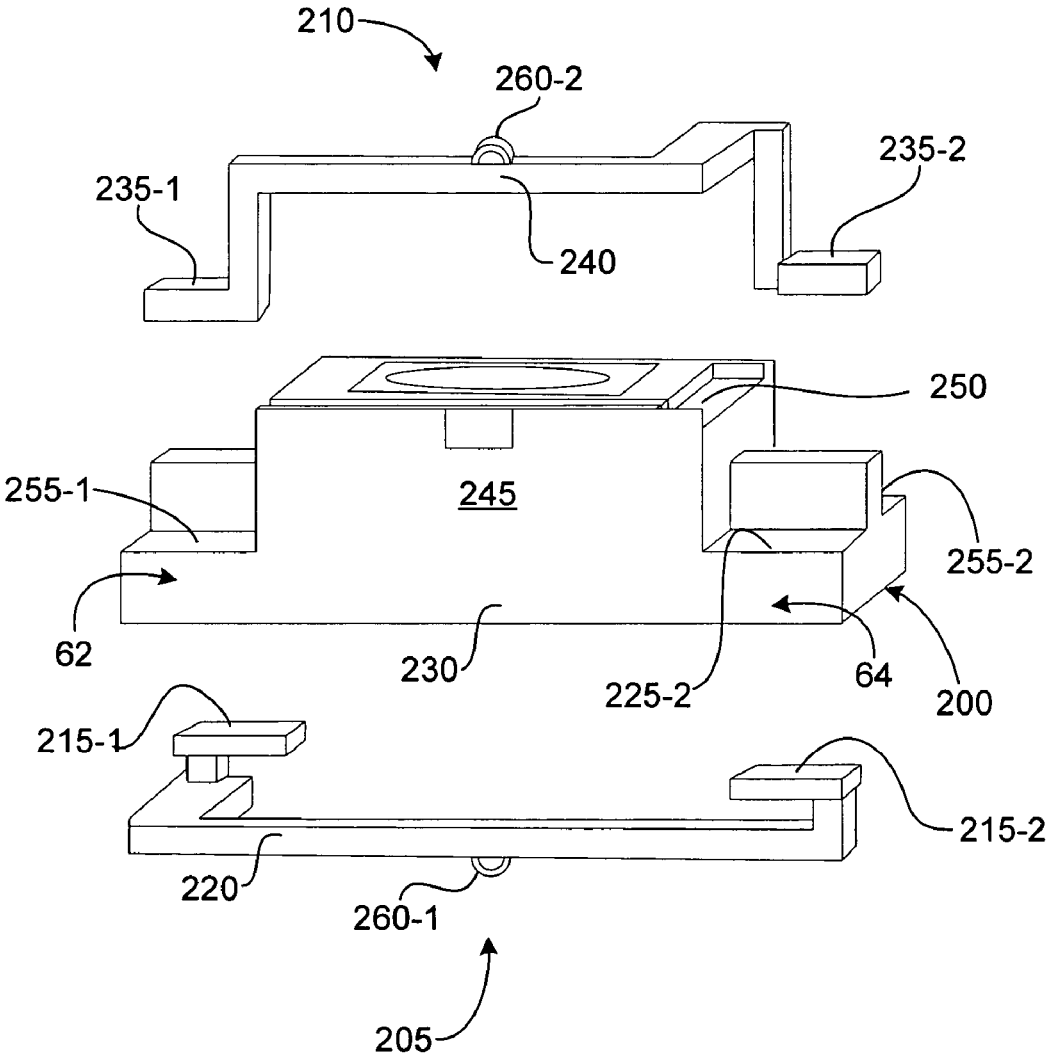
FIG. 2 is an exploded view of an exemplary lamp header.
Figure 3A:
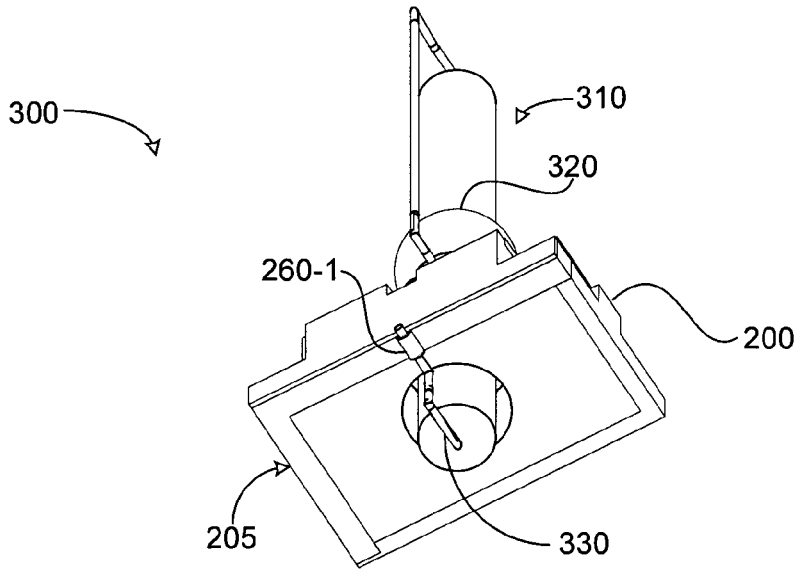
FIG. 3A is a bottom perspective view of an exemplary lamp assembly.
Figure 3B:
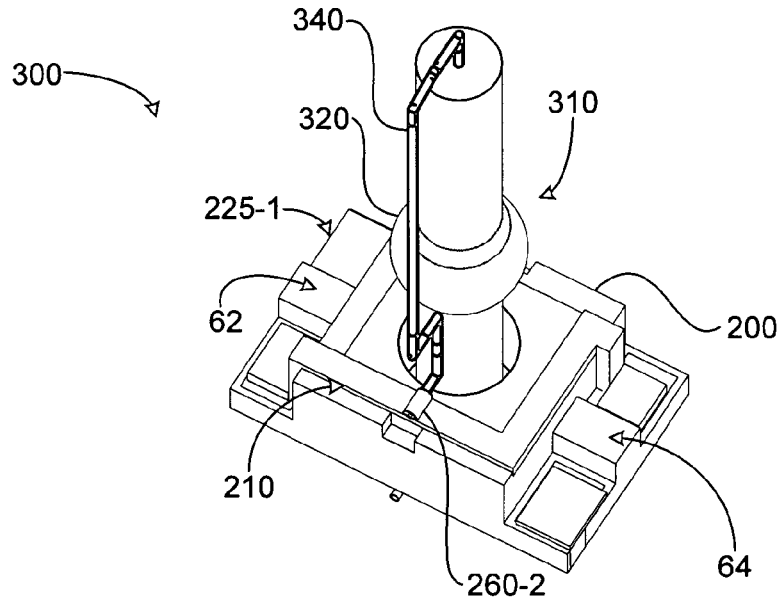
FIG. 3B is a top perspective view of the exemplary lamp assembly shown in FIG. 3A.
Figure 4:
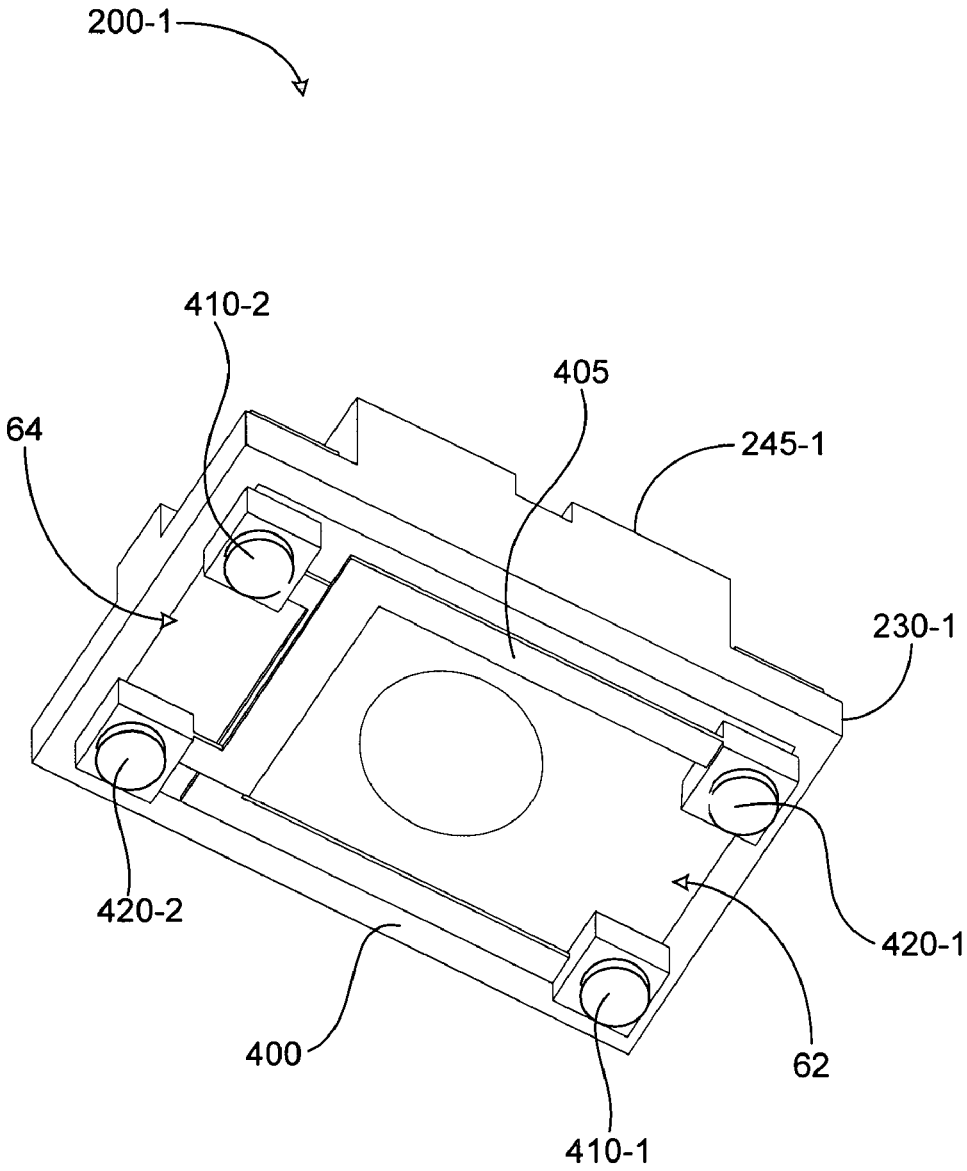
FIG. 4 is a bottom perspective view of an exemplary lamp header.

Some exemplary configurations of lamp headers and lamp assemblies will now be discussed in more detail. In particular, FIG. 2 illustrates an exemplary lamp header with pre-formed metal contacts. FIGS. 3A–3B illustrate a lamp assembly that makes use of a header with pre-formed metal contacts coupled thereto. FIG. 4 illustrates an exemplary lamp header with flexible interconnects, while FIGS. 5A–5B show an exemplary lamp assembly having a lamp header with flexible interconnects. FIGS. 6A–6B show an exemplary lamp assembly that uses two-sided circuit board interconnects. Each of these lamp headers and assemblies make use of connection assemblies that reduce production costs.

Pre-Formed Electrical Contacts

FIG. 2 illustrates a lamp header (200) having pre-formed metal contacts (205, 210) coupled thereto. The pre-formed contacts are external to the lamp header and include a first contact (205) configured to be coupled to the bottom of the lamp header (200) and a second contact (210) configured to be coupled to the top of lamp header (200). This configuration places first and second source connections on each of the first and second lateral portions (62, 64) of the lamp header (200) that are coupled to first and second source connection on the other side of the lamp header (200). This configuration also provides for the coupling of each of the first and second source connections to first and second leads of a lamp. The general characteristics of the first contact will first be discussed, followed by a discussion of corresponding characteristics of the lamp header and the interaction between the first contact and the lamp header.

The first contact (205) includes a plurality of first-source connections (215-1, 215-2) that are connected by a first interconnect (220). In particular, the first-source connections (215-1, 215-2) shown are integrally formed with the first interconnect (220) out of a metallic material. As a result, the first-source connections (215-1, 215-2) are physically connected by a first interconnect (220). The lamp header (200) and the first contact (205) are shaped to allow them to be coupled together.

The exemplary lamp header (200) includes first source recesses (225-1, best seen in FIG. 3B, 225-2) formed on a base member (230). These first source recesses (225-1, 225-2) correspond to the first source connections (215-1, 215-2). Further, the lamp header (200) may be formed of a solid ceramic material.

As shown in FIG. 2, the first interconnect (220) has approximately the same width as the base member (230). Further, the depth of the first interconnect (220) is slightly less than the distance between the bottom of the base member (230) and the first source recesses (225-1, 225-2). In order to couple the first contact (205) to the lamp header (200), the first contact (205) is temporarily deformed slightly to allow the first source connections (215-1, 215-2) configured to be placed over the base member (230). Thereafter, the first contact (205) returns to its original shape such that the first source connections (215-1, 215-2) are in contact with the first source recesses (225-1, 225-2) while exerting a compressive force on the base member (230). This compressive force helps ensure that the first contact (205) remains coupled to the lamp header (200). The overlap of the first contact (205) with respect to the base member (230) further helps ensure the first contact (205) will remain coupled to the lamp header (200).

In a similar manner, the second source connection (210) is configured to be coupled to the top of the lamp header (200), as will now be discussed first with reference to the general characteristics of the second contact (210), followed by a discussion of the corresponding characteristics of the lamp header and the interaction between the second contact and the lamp header.

The second contact (210) includes second source connections (235-1, 235-2) that are connected by a second interconnect (240). The second contact (210), including the second source connections (235-1, 235-2) and the second interconnect (240) may be formed as an integral piece of metallic material.

The lamp header (200) includes a lamp engaging member (245) that is coupled to the base member (230). The lamp engaging member (245) has a cavity defined therein for receiving a lamp, as will be discussed in more detail with reference to FIGS. 3A–3B. The lamp engaging member (245) also has an interconnect channel (250) defined therein for receiving the second interconnect (240). Further, the lamp engaging member (245) also includes second source recesses (255-1, 255-2) that correspond to the second source connections (235-1, 235-2). The entire lamp header (200), including the base (230) and the lamp engaging member (245), may be entirely molded of ceramic material.

The second contact (210) is coupled to the lamp header (200) by placing the second interconnect (240) into the interconnect channel (250). The second contact (210) may be secured thereto through high temperature adhesives. Further, the second interconnect (240) may be slightly narrower than the lamp engaging member (245) such that when the second contact (210) is coupled to the lamp header (200), the second interconnect (240) exerts a compressive force on the lamp engaging member (245).

Accordingly, the first and second contacts (205, 210) are configured to be readily coupled to the lamp header (200). Further, the first and second contacts (205, 210) are electrically insulated from one another by the lamp header (210) while being routed externally around the lamp header (200). Such a configuration allows the contacts to be rapidly formed and coupled to the lap header as preformed units.

As a result, such a configuration may reduce the time and therefore the costs associated with forming a replaceable lamp header. Further, the use of a replaceable lamp header reduces the cost of operating and/or owning a light generation assembly that makes use of such an assembly, as will be discussed below. The first and second contacts (205, 210) include corresponding retaining members (260-1, 260-2). As will now be discussed, these retaining members (260-2, 260-2) allow a lamp to be rapidly coupled to the lamp header (200).

FIG. 3A is a bottom view of a lamp assembly (300) that generally includes a lamp (310) coupled to a lamp header (200). An example of a lamp is an ultra-high pressure mercury arc lamp. For ease of reference, a UHP lamp will be described in the illustrated implementation. The lamp (310) creates a fireball in a central portion (320) of a mercury vapor or other vapor filled tube that results in the generation of a plasma caused by an arc across first and second electrodes. The arc is created by a voltage difference or potential across the first and second electrodes. The voltage difference between the first and second electrodes is supplied by a power source. The lamp assembly (300) includes a first lead (330) coupled to the first retaining members (260-1). Further, as shown in FIG. 3B, the lamp assembly (300) includes a second lead (340) coupled to the second retaining member (260-2).

As previously discussed, the retaining members (260-1, 260-2) are coupled to the first and second contacts (205, 210). As a result, coupling the first and second leads (330, 340) to the first and second contacts (205, 210) allows the lamp (310) to be coupled to a power source as discussed with reference to FIG. 1. The first and second leads (330, 340) are coupled to the first and second contacts (205, 210) by passing the first and second leads (330, 340) through the first and second retaining members (260-1, 260-2).

The first and second leads (330, 340) may then be coupled to the first and second retaining members (260-1, 260-2). For example, the first and second retaining members (260-1, 260-2) may be crimped, soldered, glued, screwed, riveted, etc to join the first and second leads (330, 340) thereto. These securing operations may be performed quickly to secure the first and second leads while minimizing or eliminating curing time for an adhesive to secure the first and second leads to the first and second retaining members.

Accordingly, the lamp assembly (300) may be rapidly assembled by coupling the first and second contacts (205, 210) to the lamp header (200) and coupling the first and second leads (330, 340) to the source connections. The resulting lamp assembly (300) may then be replaceably coupled to a reflector assembly such that when the lamp assembly (300) has surpassed its useful life, the lamp assembly (300) alone may be replaced. Further, the lamp assembly (300) may be coupled to a reflector assembly in a plurality of orientations while still providing electrical coupling of the lamp (310) to a power source. This ability may be due, at least in part, to the coupling of source connections to each of the first and second lateral portions (62, 64). As a result, the central portion (320) of the lamp (310) may be maintained in a properly aligned position with respect to a reflector assembly, thereby improving the efficiency of the lamp assembly.

Lamp Header and Lamp Assembly With Flexible Electrical Interconnects

FIG. 4 illustrates a bottom perspective view of an exemplary lamp header (200-1) that includes flexible interconnects (400, 405). As will be discussed in more detail, the lamp header (200-1) includes structure for coupling first and second source connections on each of the first and second lateral portions (62, 64) of the lamp header (200-1), thereby allowing the lamp header (200-1) to be coupled to a reflector assembly in a plurality of orientations while providing electrical coupling between an electrical source and the lamp header.

The lamp header (200-1) includes a base member (230-1) and a lamp engaging member (245-1), similar to the lamp header shown and discussed with reference to FIGS. 2, 3A, and 3B, as well as first pad recesses (225-1, 225-2) and second pad recesses (255-1, 255-2).

First and second rivets (410-1, 410-2, 420-1, and 420-2 respectively) are coupled to the lamp header (200-1). The first and second rivets (410-1, 410-2, 420-1, 420-2) extend through holes defined in the first and second interconnects (400, 405) and further extend through holes defined in the base (230-1) and are coupled to first and second source connections (215-1, 215-2, 235-1, 235-2 not shown) on the opposing side of the base (230-1). This configuration allows a lamp coupled to the lamp header (200-1) to be coupled to a power source, while the lamp header (200-1) is coupled to a reflector assembly in a plurality of orientations.

Figure 5:
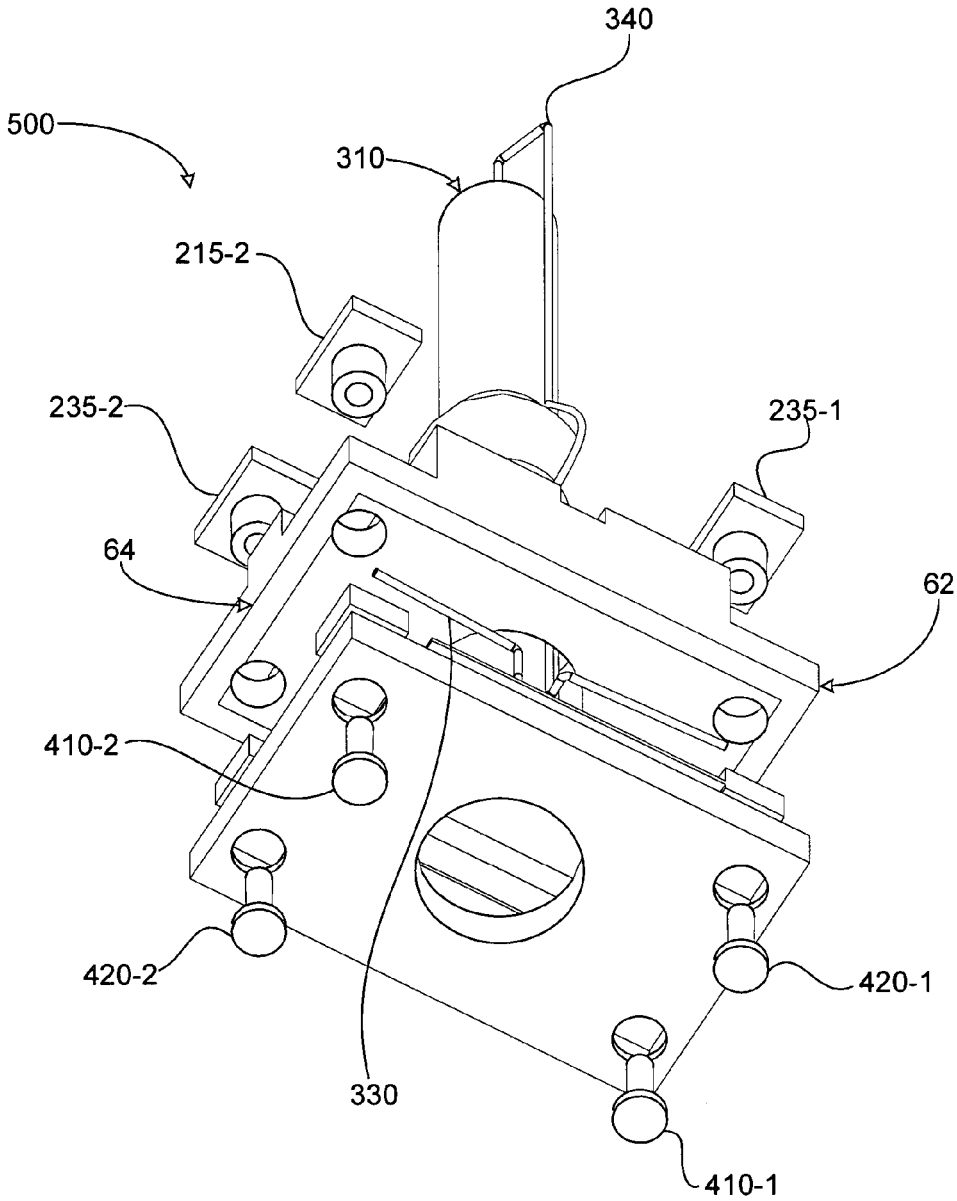
FIG. 5 is a bottom perspective exploded view of an exemplary lamp assembly.
Figure 6A:
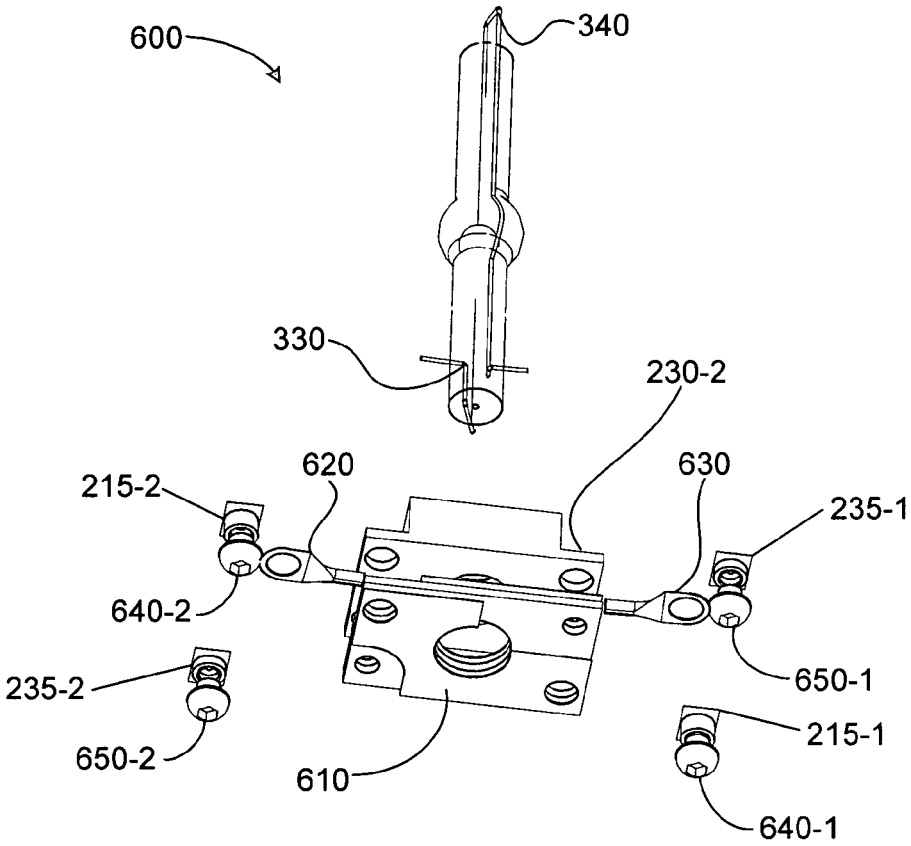
FIG. 6A is a bottom perspective exploded view of an exemplary lamp assembly.
Figure 6B:
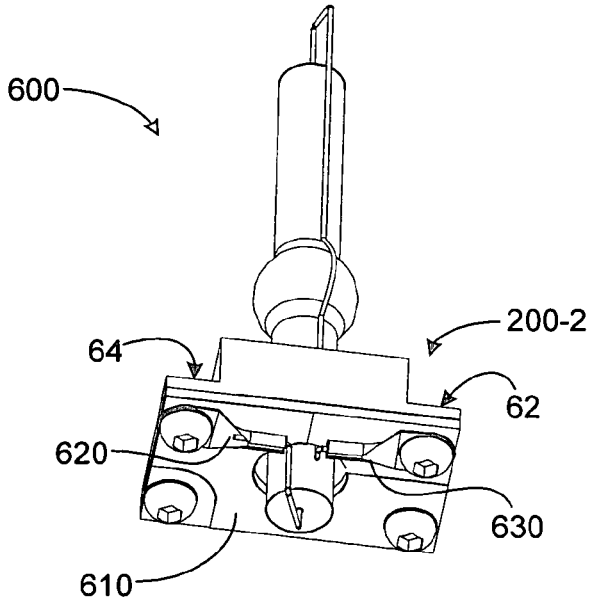
FIG. 6B is a bottom perspective assembled view of the lamp assembly shown in FIG. 6A Throughout the drawings similar elements in different embodiments are designated with similar prefixes and different suffixes. Identical reference numbers designate similar, but not necessarily identical, elements.

FIG. 5 illustrates a bottom perspective exploded view of a lamp assembly (500). The lamp assembly (500) includes a lamp (310) coupled to the lamp header (200-1). The lamp (310) includes first and second leads (330, 340) coupled to the lamp header (200-1). In particular, the first and second leads (330, 340) may be rapidly coupled to the lamp header (200-1, FIG. 4), thereby reducing the time for forming a lamp assembly (500) and thus decreasing the cost of such assemblies.

For example, the first lead (330) is shown placed between one terminal of the first flexible interconnect (400) and the base (230-1). According to such a configuration, one of the rivets, such as first rivet (410-1), couples the first lead (330) to the first source connection (215-2). The coupling of the first lead (330) to one first source connection (215-2) and the first flexible interconnect (400) also couples the first lead (330) to the other first source connection (215-1). Accordingly, a first source connection is coupled to each side of the lamp header (200-1) to couple the lamp (310) to a power source. As a result, the lamp assembly (500) may be coupled to a reflector assembly in a plurality of orientations while providing power to the lamp (310).

Similarly, another of the rivets, such as second rivet (420-1), is shown coupled to the second source connection (235-1), one terminal of the second flexible interconnect (405), and the second lead (340). As a result, a second source connection is coupled to each side of the lamp header (200-1) to couple the lamp to a power source. Accordingly, a first and a second source connection are disposed on each of the first and second lateral portions (62, 64) of the lamp header (200-1) such that the lamp assembly (500) may be coupled to a reflector assembly in a plurality of orientations while providing power to the lamp (310).

Any suitable method may be used to couple a lead, a terminal of a flexible interconnect, and a source connection. For example, the source connections and the rivets may be interlocking parts, such that the source connections and rivets may be coupled by pressing or pushing them together. Thereafter, the leads may be ultrasonically welded to the rivets to complete the coupling. These methods may decrease the time required to form a lamp assembly and thus the overall expense of the resulting lamp assembly.

Lamp Header and Lamp Assembly with Two-Sided Circuit Board

FIGS. 6A–6B illustrates a lamp assembly (600) that includes a two-sided circuit board (610). In particular, FIG. 6A shows an exploded view of the lamp assembly (600) while FIG. 6B shows an assembled view of the lamp assembly (600). In a similar manner as has been previously discussed, a first source connection and a second source connection are disposed on each side of the lamp assembly (600). Such a configuration allows the lamp assembly (600) to be coupled to a reflector assembly in a plurality of orientations while providing power to the lamp.

The two-sided circuit board (610) has electrically conductive layers formed on each side. In particular, the electrically conductive layer on the bottom side of the two-sided circuit board (610) extends between opposing corners of the two-sided circuit board (610) without covering the other opposing corners. Similarly, the top side of the two-sided circuit board (610) has an electrically conductive layer that connects the other two opposing corners. The two electrically conductive layers are separated by an insulating layer that electrically separates the layers. This configuration allows the first source connections to be electrically coupled to each other and to the first lead rapidly, while minimizing or eliminating a short with the other electrically conductive layers, etc.

The exemplary lamp assembly (600) shown includes a first terminal lug (620) and a second terminal lug (630). These terminal lugs are configured to provide coupling between the first and second leads (330, 340 respectively) and the electrically conductive layers on either side of the two-sided circuit board (610).

First and second screws (640-1, 640-2, 650-1, and 650-2 respectively) are used to secure the two-sided circuit board (610) to the lamp header (200-2) and to couple the two-sided circuit board (610) to the first and second source connections (215-1, 215-2, 235-1, 235-2). In particular, the screws extend through corresponding openings defined in the two-sided circuit board (610), the base (230-2) of the lamp header (200-2), and the terminal lugs (620, 630) into corresponding holes in the first and second source connections (215-1, 215-2, 235-1, 235-2). Further, the screws (640-1, 640-2, 650-1, and 650-2) are configured to extend into corresponding holes in the first and second source connections (215-1, 215-2, 235-1, 235-2).

This configuration thus provides an electrical path from the first lead (330) to the first terminal lug (620), from the first terminal lug (620) to the electrically conductive layer on the bottom of the two-sided circuit board (610), from the electrically conductive layer to each of the first screws (640-1, 640-2), and from the first screws (640-1, 640-2) to the first source connections (215-1, 215-2). Accordingly, this configuration couples the first lead (330) to each of the first source connections (215-1, 215-2). The second lead (340) is coupled to the second source connections (235-1, 235-2) in a similar manner wherein the second terminal lug (630) is coupled to an electrically conductive layer on the top of the two-sided circuit board (610).

As a result, a first and second source connection coupled to each of the first and second lateral portions (62, 64). As previously discussed, this configuration allows the lamp assembly (600) to be coupled to a reflector assembly in a plurality of orientations while providing electrical connections to the lamp. Once the lamp assembly (600) has surpassed its useful life, the lamp assembly (600) alone may be replaced, thereby reducing costs.

Further, this configuration increases the speed of forming lamp assemblies, thereby reducing cost. In particular, the two-sided circuit board may be rapidly formed as a component of the lamp assembly. Once the two-sided circuit board (610) is available, the lamp may be quickly secured to the two-sided circuit board (610) with the terminal lugs. These terminal lugs may then be rapidly secured to the lamp assembly with screws. The use of these screws also rapidly secures the entire assembly together while providing electrical coupling between the leads and the source connections. As a result, the lamp assembly may be quickly assembled, thereby reducing cost.

In conclusion, the disclosure provides for the application of adhesive through the proximal end of a lamp header. This configuration allows for more rapid and more controlled application of the adhesive. In addition, the present disclosure provides for various routing configurations of electrical connections between the lamp and source connections. Further, the lamp header may be separately replaced, thereby reducing the costs of operating a light generation assembly.

The preceding description has been presented only to illustrate and describe the present method and apparatus. It is not intended to be exhaustive or to limit the disclosure to any precise form disclosed. Many modifications and variations are possible in light of the above teaching. It is intended that the scope of the invention be defined by the following claims.

What is claimed is:

1. A replaceable lamp header for positioning a lamp within a reflector assembly, comprising:

a base member having first and second lateral portions;

at least one first source connection coupled to each of said first and second lateral portions;

at least one second source connection coupled to each of said first and second lateral portions;

a first interconnect coupling said first source connections and being external to said base member; and a second interconnect coupling said second source connections and being external to said base member.

2. The lamp header of claim 1, and wherein said first source connections and said first interconnect comprises a first contact and said second source connections and said second interconnect comprises a second contact.

3. The lamp header of claim 2, and wherein said first interconnect extends across a bottom portion of said base member and said second interconnect extends across a top portion of said base member.

4. The lamp header of claim 2, and wherein said first and second contacts comprise a metallic maternal.

5. The lamp header of claim 1, and wherein said first and second interconnects comprise flexible interconnects.

6. The lamp header of claim 5, and further comprising rivets coupling said first interconnect to each of said first source connections and coupling said second interconnect to each of said second source connections.

7. The lamp header of 1, and wherein further comprising a two-sided circuit board and said first interconnect comprises an electrically conductive layer formed on a first side of said two-sided circuit board and said second interconnect comprises an electrically conductive layer formed on a second side of said two-sided circuit board in which said second side is opposite said first side.

8. The lamp header of claim 7, and further comprising screws coupling said first interconnect to each of said first source connections and coupling said second interconnect to each of said second source connections.

9. The lamp header of claim 1, and wherein said base member comprises a ceramic material.

10. The lamp header of claim 1, wherein each of said first and second interconnects external to said base member comprises an opening for receiving a lead from a lamp to electrically couple said first and second interconnects with that lamp.

11. A lamp assembly, comprising:

a lamp header having first and second lateral portions, at least one first source connection coupled to each of said first and second lateral portions, at least one second source connection coupled to each of said first and second lateral portions, a first interconnect coupling said first source connections and being external to said base member, and a second interconnect coupling said second source connections and being external to said base member; and a lamp coupled to said lamp header.

12. The lamp assembly of claim 11, and wherein said lamp header further comprises lead engaging members.

13. The lamp assembly of claim 12, and wherein said lead engaging members are configured to be joined to lamp leads.

14. The lamp assembly of claim 11, and wherein said lamp includes first and second leads coupled to said first and second source connections.

15. The lamp assembly of claim 14, and wherein said first interconnect extends across a bottom portion of said base member and said second interconnect extends across a top portion of said base member.

16. The lamp assembly of claim 14, and wherein said first and second interconnects comprise flexible interconnects.

17. The lamp assembly of claim 16, and wherein said first and second interconnects comprise flexible interconnect fanned on opposing sides of a two-sided circuit board.

18. The lamp assembly of claim 11, and wherein said lamp comprises an ultra high pressure lamp.

19. The lamp assembly of claim 10, and further comprising at least one lead retaining member coupled to each of said first and second electrical interconnects.

20. The lamp assembly of claim 19, and wherein said lead retaining members comprise terminal lugs.

21. The lamp assembly of claim 19, and wherein each of said lead retaining members are configured to be joined to a lamp lead.

22. The lamp assembly of claim 11, wherein said lamp is electrically coupled to said first and second interconnects, said coupling being external to said base member.

23. A light generation assembly, comprising:

a lamp header having first and second lateral portions, at least one first and second source connection coupled to each of said first and second lateral portions, and a first and a second interconnect externally coupling said first and second source connections respectively;

a lamp coupled to said lamp header; and a reflector assembly wherein said lamp header is configured to be replaceably coupled to said reflector assembly.

24. The light generation assembly of claim 23, and wherein said reflector is coupled to a power source and said reflector is configured to couple said power source to said lamp via at least one each of said first and source connections.

25. The light generation assembly of claim 24, and wherein said lamp header is configured to be coupled to said reflector in a plurality of orientations.

26. A method of forming a lamp assembly, comprising:

forming a lamp header having first and second lateral portions;

coupling first and second external electrical connections to each of said first and second lateral portions of said lamp header; and coupling a lamp to said lamp header and said first and second electrical connections.

27. The method of claim 26, and wherein coupling said lamp to said first and second source connections comprises coupling a first lead of said lamp to said first external electrical connections and coupling a second lead of said lamp to said second external electrical connections.

28. The method of claim 27, and wherein coupling said first lead to said first external electrical connections and coupling said second lead to said second external electrical connections comprises joining lead retaining members.

29. The method of claim 28, and wherein coupling said first lead to said first external electrical connections and coupling said second lead to said second external electrical connections comprises riveting said first and second leads to said first and second external electrical connections.

30. The method of claim 29, and wherein riveting said first and second leads to said first and second electrical connections comprises riveting said first and second leads to terminals of first and second flexible interconnects.

31. The method of claim 28, and wherein coupling said first lead to said first external electrical connections and coupling said second lead to said second external electrical connections comprises securing said first and second leads to first and second terminal lugs.

* * * * *

UNITED STATES PATENT AND TRADEMARK OFFICE

CERTIFICATE OF CORRECTION

PATENT NO. : 7,220,046 B2
APPLICATION NO. : 10/903536
DATED : May 22, 2007
INVENTOR(S) : Lee et al.

It is certified that error appears in the above-identified patent and that said Letters Patent is hereby corrected as shown below:

Col. 9 (line 16), delete “maternal.” and insert therefor --material.--

Col. 9 (line 67), delete “fanned” and insert therefor --formed--.

Signed and Sealed this

Sixth Day of November, 2007

JON W. DUDAS
*Director of the United States Patent and Trademark Office*